United States Patent [19]

Wehrmeister

[11] 4,380,891

[45] Apr. 26, 1983

[54] DEVICE FOR FEEDING A LIQUID THREAD-TREATING MEDIUM TO THE THREAD IN A DOUBLE THREAD TWISTING MACHINE

[75] Inventor: Gerhard Wehrmeister, Kempten, Fed. Rep. of Germany

[73] Assignee: Saurer-Allma GmbH, Kempten, Fed. Rep. of Germany

[21] Appl. No.: 272,619

[22] Filed: Jun. 11, 1981

[30] Foreign Application Priority Data

Jul. 16, 1980 [DE] Fed. Rep. of Germany ... 8019080[U]

[51] Int. Cl.[3] ..... D01H 13/30; D01H 7/86

[52] U.S. Cl. ..... 57/296; 57/58.49; 57/58.83

[58] Field of Search ..... 57/58.49, 58.83, 296

[56] References Cited

U.S. PATENT DOCUMENTS 3,864,901 2/1975 Beymes et al. ..... 57/296

3,983,685 10/1976 Scherf et al. ..... 57/296

4,051,651 10/1977 Wahler et al. ..... 57/296

*Primary Examiner*—Donald Watkins

*Attorney, Agent, or Firm*—Flynn, Thiel, Boutell & Tanis

[57] ABSTRACT

A device for feeding a liquid thread-treating medium to the thread in a double thread twisting machine has a wiping head of a wear-resistant material arranged in a housing and extending from below into an annular recess of the overflow plate and into the thread running plane. The wiping head has an opening in the top thereof which extends substantially parallel to the spindle axis and has an insert in the opening which induces a capillary action that transports the thread-treating medium from a supply pipeline to the upper port of the opening. The insert is a pin made of a rigid material and of noncylindrical cross section so that between the outer surface of the pin and the inner surface of the opening small gaps are formed which produce the capillary action.

9 Claims, 2 Drawing Figures

20
4
F
4b
3b
4a
E
E
8b
5
3a
3
8
6a
2
11
N
N
6
11b
7a
6b
7
1
9
21
22
10
Level Regulator
A 11
5
8a
12
11a

DEVICE FOR FEEDING A LIQUID THREAD-TREATING MEDIUM TO THE THREAD IN A DOUBLE THREAD TWISTING MACHINE

FIELD OF THE INVENTION

This invention relates to a device for feeding a liquid thread-treating medium to the thread of a double thread twisting machine and, more particularly, to such a device having a wiping head of a wear-resistant material which extends into a thread-running plane, has an opening therein and has an insert in the opening which induces a capillary action to transport the thread-treating medium from a supply pipeline to the port of the opening.

BACKGROUND OF THE INVENTION

A conventional device of the foregoing type is disclosed in German OS NO. 24 34 899 and serves to intermittently apply a thread-treating medium in the form of a wetting agent or a lubricant onto the thread. During the rotation of the storage disk and the overflow plate, the portion of the thread extending tangentially of the storage disk and from there over the edge of the overflow plate moves in a defined path of rotation. The wiping head extends into such path of rotation. During each spindle rotation, the thread wipes over the wiping head and thereby takes along a certain amount of the thread-treating medium. This then serves to reduce friction between the balloon-limiting means and the thread, which results in reduced wear and also substantially reduces the danger of yarn damage and thread breakage. In the conventional device, the insert consists of a suction member such as a wick, for example, of felt, which reaches from the supply pipe to the port of the opening in the wiping head. The disadvantage of this conventional device is that the amount of the thread-treating medium which exits at the port varies considerably due to the fact that the wicks produce varying capillary actions which cannot be precisely controlled. Furthermore, such suction member inserts are particularly subject to aging, as a result of which their suction capability is reduced.

In a different conventional device for feeding a liquid thread-treating medium to the thread in a double thread twisting machine, as disclosed for example in German OS No. 28 03 488, the wiping head consists of a plurality of thin steel plates which are arranged side-by-side with a small horizontal spacing, the planes of which extend substantially tangentially with respect to the spindle axis and the lower parts of which are immersed in the thread-treating medium. Here, too, the thread-treating medium is moved through by the capillary action induced by the gaps between the steel plates to the upper edges of the plates where it is wiped over by the thread. This device, however, is relatively expensive to manufacture because, in addition to the steel plates, two disks which hold the steel plates and a relatively expensive housing which encloses the wiping head are needed.

The primary purpose of the invention is thus to produce a device for feeding a liquid thread-treating medium to the thread in a double thread twisting machine of the above-mentioned type which is simple in structure and which supplies a precisely predeterminable amount of the thread-treating medium to the thread without aging symptoms over a long period of time.

SUMMARY OF THE INVENTION

This is achieved according to the invention by providing an insert which is a pin made of a rigid material and having a noncylindrical cross section so that, between the outer surface of the pin and the inner surface of the opening, narrow gaps are formed which produce the capillary action.

The entire device is very simple in its design. The wiping head need only have a cylindrical opening into which is inserted the pin of noncylindrical cross section. Such pins can readily be obtained in commerce as rods having a square cross section. By suitably choosing the diameter of the opening and the cross section of the pin, the amount of the thread-treating medium which is moved to the port of the opening can easily be predetermined. This amount does not change after a long operation because the pin is not exposed to use tending to produce any type of aging symptoms. Furthermore, the device operates in a totally wear-free manner.

A further advantage exists where the amount of the emitted thread-treating medium can be changed. This is achieved by making the pin exchangeable. If a pin with a certain cross section is exchanged with one having a different cross section, then, depending on the cross-sectional shape, more or less thread-treating medium will be transported to the upper port of the opening.

BRIEF DESCRIPTION OF THE DRAWINGS

The invention is described in greater detail hereinafter in connection with one exemplary embodiment which is illustrated in the drawings, in which.

DETAILED DESCRIPTION

Figure 1:
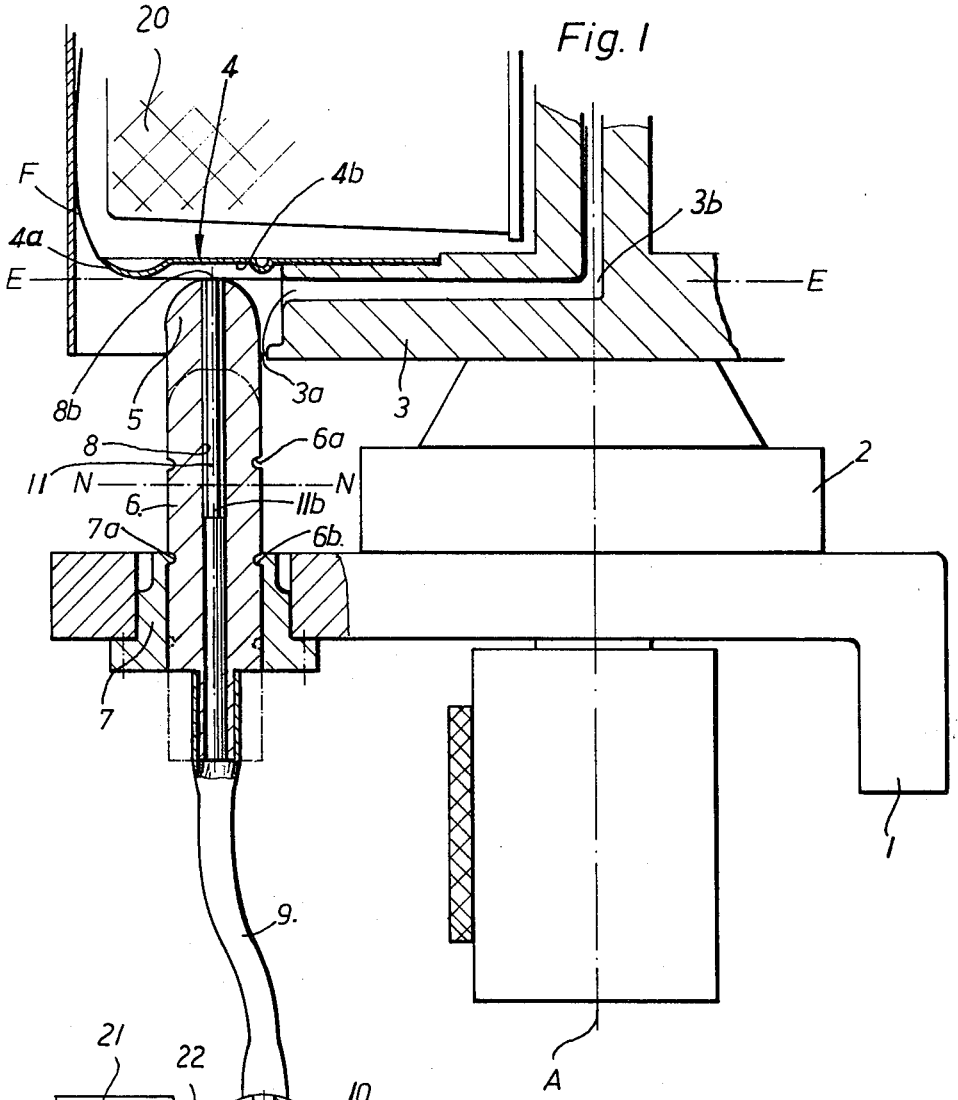
FIG. 1 is a longitudinal, cross-sectional view of a portion of a double thread twisting spindle embodying the present invention.

A double thread twisting spindle 2 is conventionally supported for rotation about an axis A on a spindle carrier 1. A thread F which is to be treated with a liquid medium exits from an outlet opening 3*a* of a rotating storage disk 3 of the spindle 2 and travels over the edge 4*a* of an overflow plate 4 of the spindle 2. The overflow plate 4 has a downwardly facing annular recess 4*b* coaxial with the axis A. A wiping head 5 of the device extends from below slightly into the thread running plane E—E which is defined by the top of the outlet opening 3*a* and the lowermost point of the edge 4*a* of the overflow plate 4.

The rounded wiping head 5 is provided at the upper end of a cylindrical shaft 6 which is axially movably supported in an annular housing 7 inserted into an opening in the spindle carrier 1. The shaft 6 has two spaced annular grooves 6*a* and 6*b* which can engage an annular bead 7*a* in the central opening of the housing 7. When the bead 7*a*, as is illustrated in solid lines in FIG. 1, engages the lower annular groove 6*b*, the wiping head 5 is in its operating position. In order to shift the wiping head 5 to its inoperative position, the shaft 6 is moved downwardly until the bead 7*a* engages the upper annular groove 6*a*, as is illustrated with dash-dotted lines in FIG. 1.

The thread F is supplied to the outlet opening 3*a* from a bobbin 20 through a channel 3*b* in the storage disk 3 in a conventional manner. The wiping head 5 is aligned radially with the annular recess 4*b*.

The shaft 6 and the wiping head 5 consist preferably and advantageously of steel. A vertical cylindrical opening 8 is provided through the wiping head 5 and shaft 6 and extends substantially parallel to the spindle axis A. A supply hose or pipeline 9 is connected to the lower end of the shaft 6, communicates with the opening 8 therein, and is connected to a main pipeline 10.

Figure 2:
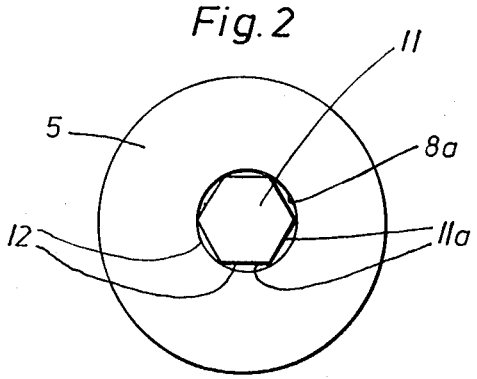
FIG. 2 is a top view of a wiping head which is a component of the spindle of FIG. 1.

A pin 11 of noncylindrical cross section, preferably made of a rigid material such as steel or brass, is inserted into the upper end of the cylindrical opening 8 so that, between the outer surface 11*a* (FIG. 2) of the pin 11 and the inner surface 8*a* of the opening 8, small, vertically extending gaps 12 are formed which produce a capillary action. The pin 11 can preferably and advantageously be exchanged. The top of the pin 11 is positioned adjacent the top of the wiping head 5.

The pin 11 preferably and advantageously has the cross section of a regular polygon, the radius of the circumscribed circle of which corresponds with the radius of the opening 8. In the illustrated exemplary embodiment, the cross section of the pin 11 is a regular hexagon. If in place of the hexagonal pin a pin with the cross section of a regular octagon or a regular square is used, then respective gaps 12 of smaller or larger cross section are created between the outer surface of the pin and the inner surface 8*a* of the opening 8, and the associated capillary action moves less or more, respectively, of the thread-treating medium to the port 8*b* at the top of the opening 8.

A level regulator 21 is connected to the interior of the main pipeline 10 by a conduit 22.

The thread-treating medium in the supply pipeline 9 and the lower part of the opening 8 is maintained at a constant level N—N by the level regulator 21 so that the lower end of the pin 11 is continually immersed in the thread-treating medium. The capillary action of the gaps 12 causes the liquid thread-treating medium to move to the port 8*b* at the top of the opening 8 and, upon each rotation of the storage disk 3, the liquid medium is wiped off the head 5 and carried along by the thread F.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a device for feeding a liquid thread-treating medium to the thread in a double thread twisting machine, including a wiping head of a wear-resistant material which extends from below into an annular recess of an overflow plate and into a thread running plane, which is arranged in a housing, which has an opening therein which extends substantially parallel to the spindle axis and which has an insert in the opening inducing a capillary action which transports thread-treating medium from a supply pipeline to the upper port of the opening, the improvement comprising wherein the insert is a pin made of a rigid material and having a noncylindrical cross section so that between the outer surface of the pin and the inner surface of the opening small gaps are formed which produce the capillary action.

2. The device according to claim 1, wherein the lower end of the pin is immersed in the thread-treating medium which is supplied by the supply pipeline.

3. The device according to claim 2, wherein the thread-treating medium is maintained at a constant level in the supply pipeline by a level regulator.

4. The device according to claim 1, wherein the pin can be exchanged.

5. The device according to claim 1 or 4, wherein the pin has a polygonal cross section.

6. The device according to claim 5, wherein the pin has the cross section of a regular polygon, the radius of the circumscribed circle of which corresponds with the radius of the opening.

7. The device according to claim 6, wherein the cross section of the pin is a regular hexagon.

8. The device according to claim 1, wherein the pin consists of steel.

9. The device according to claim 1, wherein the wiping head consists of steel.

* * * * *